US007007496B2

(12) United States Patent
Kim et al.

(10) Patent No.: US 7,007,496 B2
(45) Date of Patent: Mar. 7, 2006

(54) INTERNAL TEMPERATURE DIFFERENCE PREVENTING STRUCTURE FOR REFRIGERATOR

(75) Inventors: Tae-Hean Kim, Ansan-Si (KR); Young-Man La, Incheon (KR); Kyung-Won Cho, Incheon (KR)

(73) Assignee: Lotte Engineering & Machinery Mfg., Co., Ltd., (KR)

( * ) Notice: Subject to any disclaimer, the term of this patent is extended or adjusted under 35 U.S.C. 154(b) by 0 days.

(21) Appl. No.: 10/903,164

(22) Filed: Jul. 30, 2004

(65) Prior Publication Data

US 2005/0138954 A1 Jun. 30, 2005

(30) Foreign Application Priority Data

Dec. 30, 2003 (KR) ..... 10-2003-0100074
Dec. 30, 2003 (KR) ..... 20-2003-0040665
Feb. 26, 2004 (KR) ..... 20-2004-0005107

(51) Int. Cl.
*F25D 21/14* (2006.01)

(52) U.S. Cl. ..... 62/285; 62/291; 312/401; 312/406.2

(58) Field of Classification Search ..... 62/272, 62/285, 288, 291; 312/401, 406, 406.2, 400, 312/402, 403, 404, 405, 405.1, 407, 407.1, 312/408, 409, 410; 277/314, 334, 353

See application file for complete search history.

(56) References Cited

U.S. PATENT DOCUMENTS 3,696,632 A * 10/1972 Carlin et al. ..... 62/285
3,866,434 A * 2/1975 Pugh et al. ..... 62/340
4,352,275 A * 10/1982 Ibrahim ..... 62/256
4,490,991 A * 1/1985 Griffin ..... 62/279
4,882,911 A * 11/1989 Immel ..... 62/288
4,979,377 A * 12/1990 Fievet et al. ..... 62/274
5,499,514 A * 3/1996 Ho ..... 62/291
5,535,525 A * 7/1996 Gardner ..... 34/78
6,343,480 B1 * 2/2002 Correa et al. ..... 62/288
6,415,618 B1 * 7/2002 Sul et al. ..... 62/188
6,442,956 B1 * 9/2002 Herren ..... 62/150

FOREIGN PATENT DOCUMENTS

JP 10-205981 A * 8/1998
JP 10-267508 A * 10/1998
JP 2001-272153 A * 10/2001

* cited by examiner

*Primary Examiner*—Mohammad M. Ali
(74) *Attorney, Agent, or Firm*—Cantor Colburn LLP

(57) ABSTRACT

An internal temperature difference preventing structure for a refrigerator, including an evaporator installed in an upper portion of a refrigerating space inside a main body of the refrigerator, an air blast fan installed in front of the evaporator for blowing air toward a rear part of the evaporator, a discharge duct, including a discharge port downwardly extended from the rear part thereof, for guiding cool air, generated by the evaporator and the air blast fan, from a front part of the upper portion inside the main body to a rear part of the upper portion inside the main body, and a discharge guide portion for guiding the cool air, guided by the discharge duct to the rear part of the upper portion inside the main body, to the discharge port.

4 Claims, 10 Drawing Sheets

INTERNAL TEMPERATURE DIFFERENCE PREVENTING STRUCTURE FOR REFRIGERATOR

BACKGROUND OF THE INVENTION

1. Field of the Invention

The present invention relates to a refrigerator, and more particularly to an internal temperature difference preventing structure for a refrigerator, which prevents a temperature difference between upper and lower portions of the interior of the refrigerator.

2. Description of the Related Art

Generally, a refrigerator comprises a main body having a refrigerating space, a door, for opening and closing the main body, installed on a front surface of the main body, and internal machinery for constituting a refrigerating cycle supplying cool air to the refrigerating space. The internal machinery includes a compressor, a condenser, a capillary tube, and an evaporator.

The above conventional refrigerator intermittently circulates a refrigerant through the internal machinery, thereby supplying cool air to the refrigerating space in the main body.

The cool air is supplied to an upper or lower portion of the refrigerating space of the refrigerator through the evaporator from designated regions, thus causing a temperature difference between the upper and lower portions of the refrigerating space.

Further, the periphery of a discharge hole, for discharging condensed water generated from the evaporator, formed through the inner surface of the main body of the conventional refrigerator is not properly sealed and thermally insulated from the environment.

Moreover, support brackets, which are installed at front ends of corners in the main body of the conventional refrigerator, for supporting the main body are not thermally insulated from the environment, thereby causing variation in the temperature of the corners in the main body, on which the support brackets are installed.

SUMMARY OF THE INVENTION

Therefore, the present invention has been made in view of the above problems, and it is an object of the present invention to provide an internal temperature difference preventing structure for a refrigerator, which prevents a temperature difference between upper and lower portions of an internal refrigerating space, thereby maintaining a uniform temperature in the refrigerating space.

It is another object of the present invention to provide an internal temperature difference preventing structure for a refrigerator, in which a discharge hole formed in an inner surface of the main body for discharging condensed water is sealed and thermally insulated from the environment, thereby preventing variation in the temperature around the discharge hole.

It is yet another object of the present invention to provide an internal temperature difference preventing structure for a refrigerator, in which support brackets for supporting a main body of the refrigerator are thermally insulated from the environment, thereby preventing variation in the temperature around inner corners of the main body provided with the support brackets installed therein.

In accordance with one aspect of the present invention, the above and other objects can be accomplished by the provision of an internal temperature difference preventing structure for a refrigerator, comprising: an evaporator installed in an upper portion of a refrigerating space inside a main body of the refrigerator; an air blast fan installed in front of the evaporator for blowing air toward a rear part of the evaporator; a discharge duct, including a discharge port downwardly extended from the rear part thereof, for guiding cool air, generated by the evaporator and the air blast fan, from a front part of the upper portion inside the main body to a rear part of the upper portion inside the main body; and a discharge guide portion for guiding the cool air, guided by the discharge duct to the rear part of the upper portion inside the main body, to the discharge port.

Preferably, the discharge guide portion may include an inclined plate, installed by a designated slope at a rear corner of the upper portion of the refrigerating space in the rear of the discharge duct, such that the inclined plate corresponds to the discharge duct and the discharge port; and flanges respectively extended from upper and lower ends of the inclined plate such that the flanges contact the inner surface of the main body.

Otherwise, preferably, the discharge guide portion may include a curved plate, installed in a rounded shape at a rear corner of the upper portion of the refrigerating space in the rear of the discharge duct, such that the curved plate corresponds to the discharge duct and the discharge port; and flanges respectively extended from upper and lower ends of the curved plate such that the flanges contact the inner surface of the main body.

Preferably, a discharge guide plate provided with a plurality of through holes formed therethrough may be vertically downwardly attached to the lower end of the discharge duct corresponding to the discharge port.

More preferably, intervals of the through holes formed on the lower part of the discharge guide plate may be closer than intervals of the through holes formed on the upper part of the discharge guide plate, and the lower end of the discharge guide plate may be separated from the inner bottom surface of the main body by a designated distance.

Preferably, a discharge hole may be formed through an inner plate and an adiabatic member of the main body so that a discharge pipe connected to a bucket placed under the lower part of the evaporator is inserted into the main body through the discharge hole; and the structure may further comprise a sealing member, inserted into the inner plate through the discharge hole, for sealing and thermally insulating the circumference of the discharge hole and allowing the discharge pipe to be inserted thereinto.

Preferably, the sealing member may include a contact plate adhered to the inner plate of the main body corresponding to the discharge hole; a cavity formed in the contact plate corresponding to the discharge hole; and a reception groove, formed in the periphery of the front end of the contact plate, for receiving the inner plate provided with the discharge hole.

More preferably, the sealing member may further include a rear reception groove formed in the periphery of the rear end of the contact plate; a bent connecting pipe provided with a portion inserted into the rear reception groove and a lower end downwardly bent from the portion; and a drainage pipe, into which the bent connecting pipe is inserted.

Preferably, corner grooves may be respectively formed at corners of the front portion of the main body, L-shaped support brackets provided with a plurality of adiabatic through holes formed therethrough may be respectively inserted into the corner grooves, and bracket covers may be respectively attached to the upper surfaces of the support brackets.

More preferably, a plurality of adiabatic indentations may be formed in upper and lower ends of each of the support brackets.

Most preferably, the adiabatic through holes and the adiabatic indentations formed through one surface of the L-shaped support bracket may not overlap with the adiabatic through holes and the adiabatic indentations formed through the other surface of the L-shaped support bracket.

In accordance with another aspect of the present invention, there is provided an internal temperature difference preventing structure for a refrigerator, comprising: an evaporator installed in an upper portion of a refrigerating space inside a main body of the refrigerator; a bucket placed under the lower part of the evaporator; a discharge hole formed through an inner plate and an adiabatic member of the main body; a discharge pipe connected to the bucket and inserted into the discharge hole; and a sealing member, for sealing and thermally insulating the circumference of the discharge hole, including: a contact plate adhered to the inner plate of the main body corresponding to the discharge hole; a cavity formed in the contact plate corresponding to the discharge hole; and a reception groove, formed in the periphery of the front end of the contact plate, for receiving the inner plate provided with the discharge hole.

In accordance with yet another aspect of the present invention, there is provided an internal temperature difference preventing structure for a refrigerator, comprising: corner grooves formed at corners of a front portion of a main body of the refrigerator; L-shaped support brackets inserted into the corner grooves for supporting and reinforcing the corners of the main body; a plurality of through holes formed through the support brackets; a plurality of through indentations formed in upper and lower ends of each of the support brackets; and bracket covers respectively attached to the upper surfaces of the support brackets.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
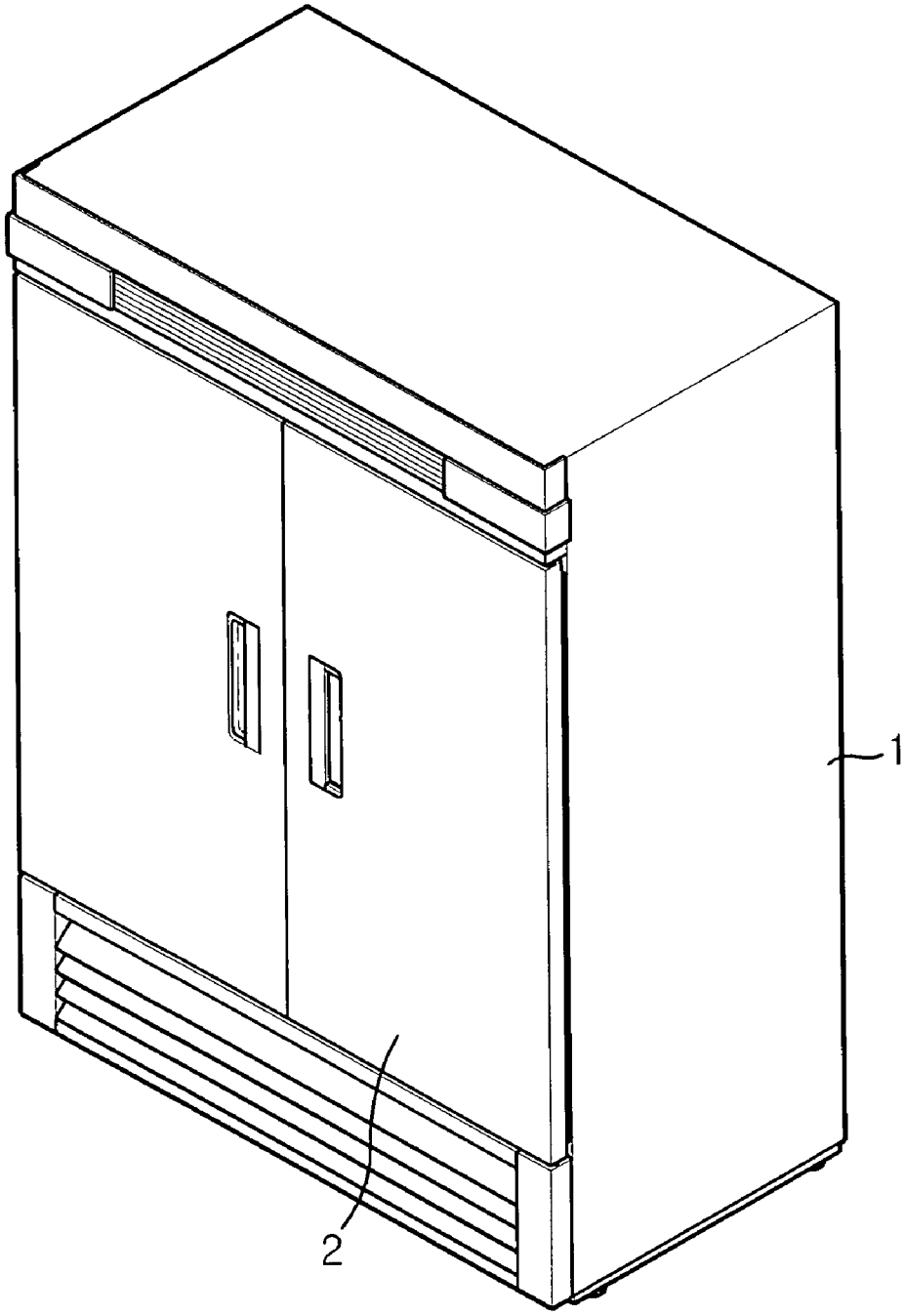
FIG. 1 is a perspective view of a refrigerator in accordance with the present invention.
Figure 2:
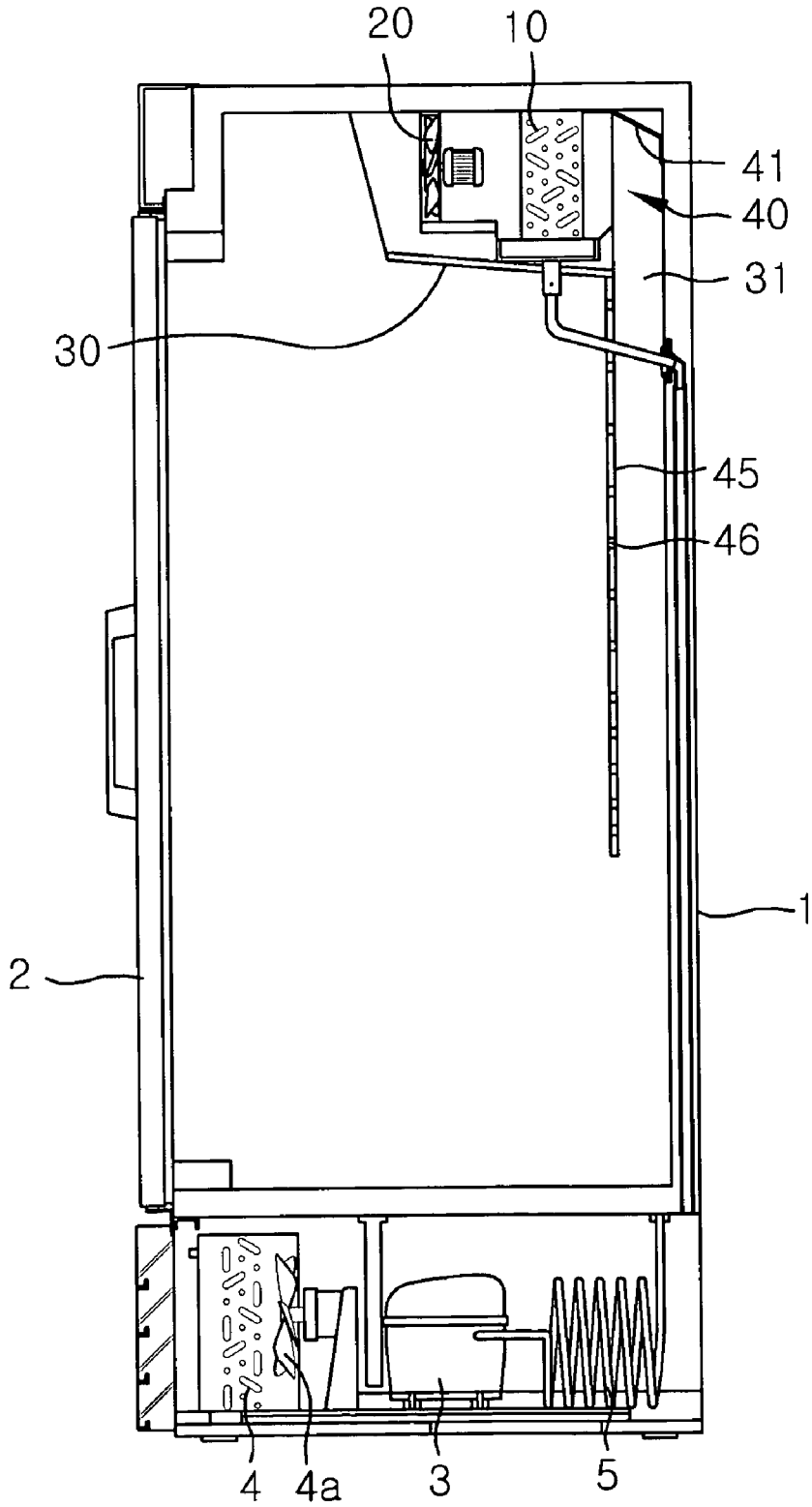
FIG. 2 is a schematic longitudinal-sectional view of the refrigerator of FIG. 1.

FIG. 1 is a perspective view of a refrigerator in accordance with the present invention, and FIG. 2 is a schematic longitudinal-sectional view of the refrigerator of FIG. 1.

As shown in FIGS. 1 and 2, the refrigerator comprises a main body 1 having a refrigerating space formed therein, a door 2, for opening and closing the main body 1, installed on a front surface of the main body 1, and a compressor 3, a condenser 4, a capillary tube 5 and an evaporator 10 for constituting a refrigerating cycle for supplying cool air to the refrigerating space. A condenser fan 4*a* is installed on a rear part of the condenser 4, the evaporator 10 is installed in a discharge duct 30 positioned in the upper portion of the inside of the main body 1, and an air blast fan 20 is installed in the discharge duct 30 in front of the evaporator 10.

The discharge duct 30 includes a discharge port 31 downwardly formed between the rear part thereof and the inner surface of the main body 1, and a discharge guide portion 40 for guiding the cool air, generated from the discharge port 31, to the inside of the main body 1.

The discharge guide portion 40 includes an inclined plate 41 installed by a designated slope at a rear corner of the upper portion of the inner surface of the main body 1 opposite to the evaporator 10, and a discharge guide plate 45 vertically attached to the lower end of the discharge duct 30 corresponding to the discharge port 31.

The inclined plate 41 serves to guide the cool air, discharged from the rear portion of the discharge duct 30 by means of the air blast fan 20 and the evaporator 10, to the discharge port 31. The discharge guide plate 45 is provided with a plurality of through holes 46 formed therethrough, thereby guiding air, guided by the inclined plate 41 and discharged downwardly through the discharge port 31, to the lower portion of the inside of the main body 1, and uniformly discharging the air to the inside of the main body 1 through the through holes 46.

Figure 3:
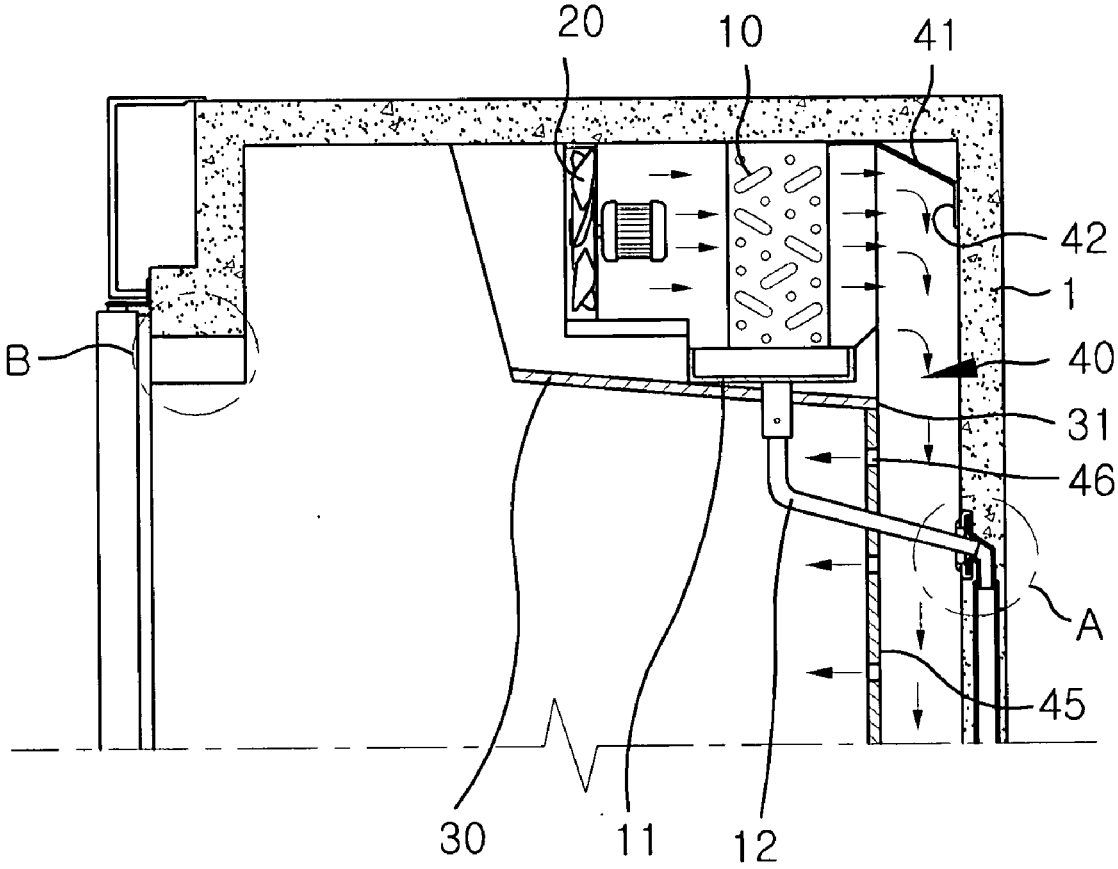
FIG. 3 is an enlarged view of a main portion of the refrigerator of FIG. 2.
Figure 4:
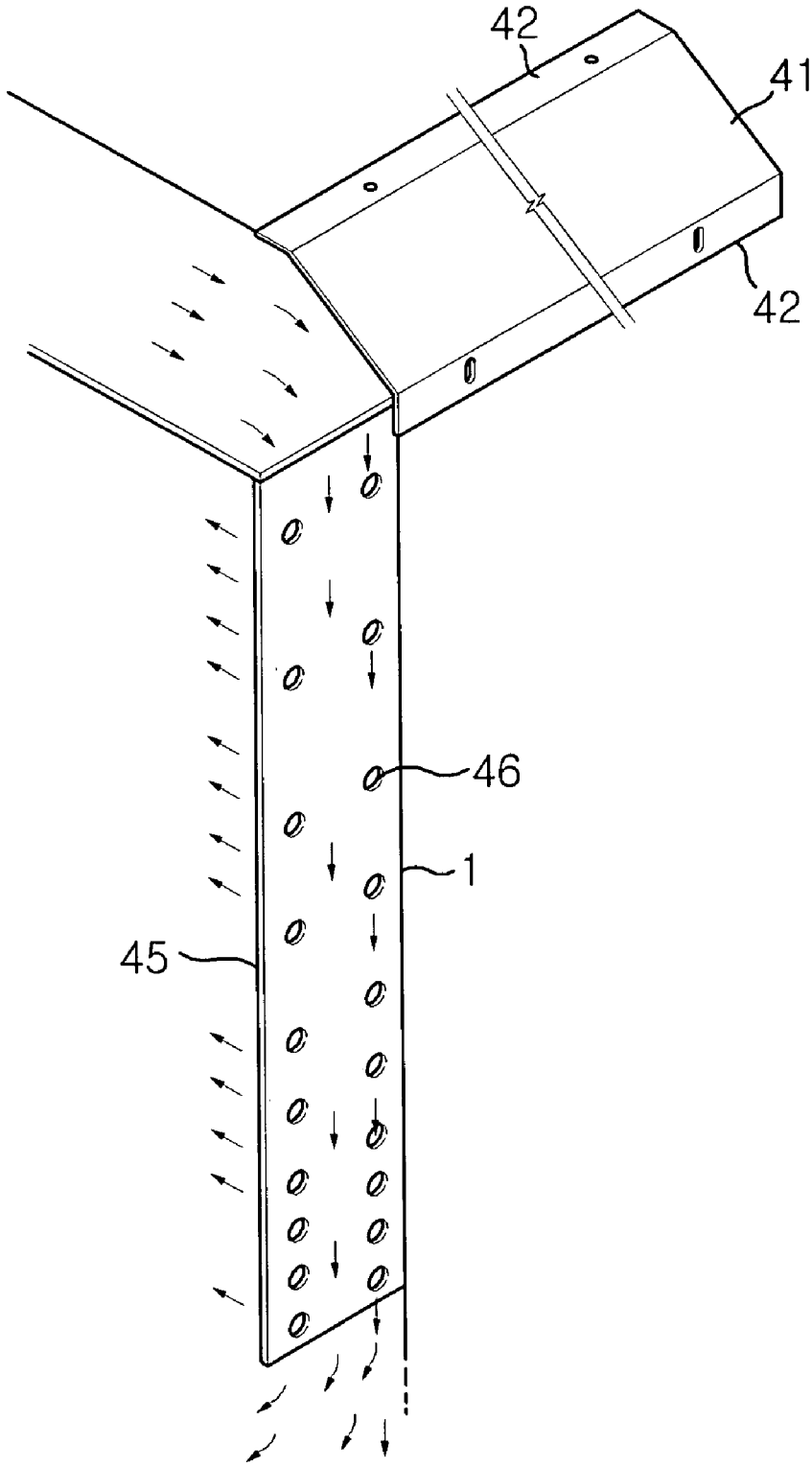
FIG. 4 is a schematic perspective view of an operation of a discharge guide portion.

FIG. 3 is an enlarged view of a main portion of the refrigerator of FIG. 2, and FIG. 4 is a schematic perspective view of an operation of the discharge guide portion.

An internal temperature difference preventing structure for a refrigerator in accordance with the present invention comprises the inclined plate 41 provided with flanges 42 respectively extended from both ends thereof so that the inclined plate 41 is installed at a rear corner of the upper portion of the inside of the main body 1, and the discharge guide plate 45 vertically attached to the lower end of the discharge duct 30 corresponding to the discharge port 31.

The internal temperature difference preventing structure simultaneously guides the cool air, discharged from the rear portion of the discharge duct 30, to the discharge port 31, and uniformly distributes the guided cool air to the inside of the main body 1, thereby preventing a temperature difference between upper and lower portions of the inside of the main body 1.

When an air blower blows air toward the rear part of the discharge duct 30, the flowing air is cooled by the evaporator 10 installed in the discharge duct 30, and condensate water generated on the surface of the evaporator 10 due to the heat loss of the evaporator 10 drops into a bucket 11 and is then discharged to the outside through a discharge pipe 12 the discharge port 31 of the discharge duct 30.

Cool air generated by the evaporator 10 passes through the rear part of the discharge duct 30, is downwardly guided by the inclined plate 41, and is then discharged to the outside through the discharge port 31 of the discharge duct 30.

The cool air, which is downwardly discharged through the discharge port 31, efficiently flows toward the lower portion of the inside of the main body 1 along the discharge guide plate 45 vertically attached to the lower end of the discharge duct 30, and is uniformly discharged to the inside of the main body 1 through the through holes 46 formed through the discharge guide plate 45.

Here, intervals of the through holes 46 formed on the lower part of the discharge guide plate 45 are closer than intervals of the through holes 46 formed on the upper part of the discharge guide plate 45, thereby allowing the cool air, discharged to the upper and lower portions of the inside of the main body 1 through the through holes 46, to be uniform. Since the discharging force of the cool air discharged from the upper part of the discharge guide plate 45 is slightly higher than that of the cool air discharged from the lower part of the discharge guide plate 45, a large quantity of the cool air is discharged from each of the through holes 46 prepared in a small number, formed through the upper part of the discharge guide plate 45, and a small quantity of the cool air is discharged from each of the through holes 46 prepared in a large number, formed through the lower part of the discharge guide plate 45.

Accordingly, the number of the through holes 46 formed through the lower part of the discharge guide plate 45 is larger than that of the through holes 46 formed through the upper part of the discharge guide plate 45, thereby allowing the cool air, discharged from the through holes 46 formed through the upper and lower parts of the discharge guide plate 45, to be uniform.

Since the lower end of the discharge guide plate 45 is spaced from the inner bottom surface of the main body 1 by a designated distance, the cool air having passes through the lower end of the discharge guide plate 45 is efficiently discharged toward the lower portion of the inside of the main body 1, thereby allowing the cool air to be uniformly discharged toward the upper, central and lower portions of the inside of the main body 1, and preventing a temperature difference of the inside of the main body 1.

Figure 5:
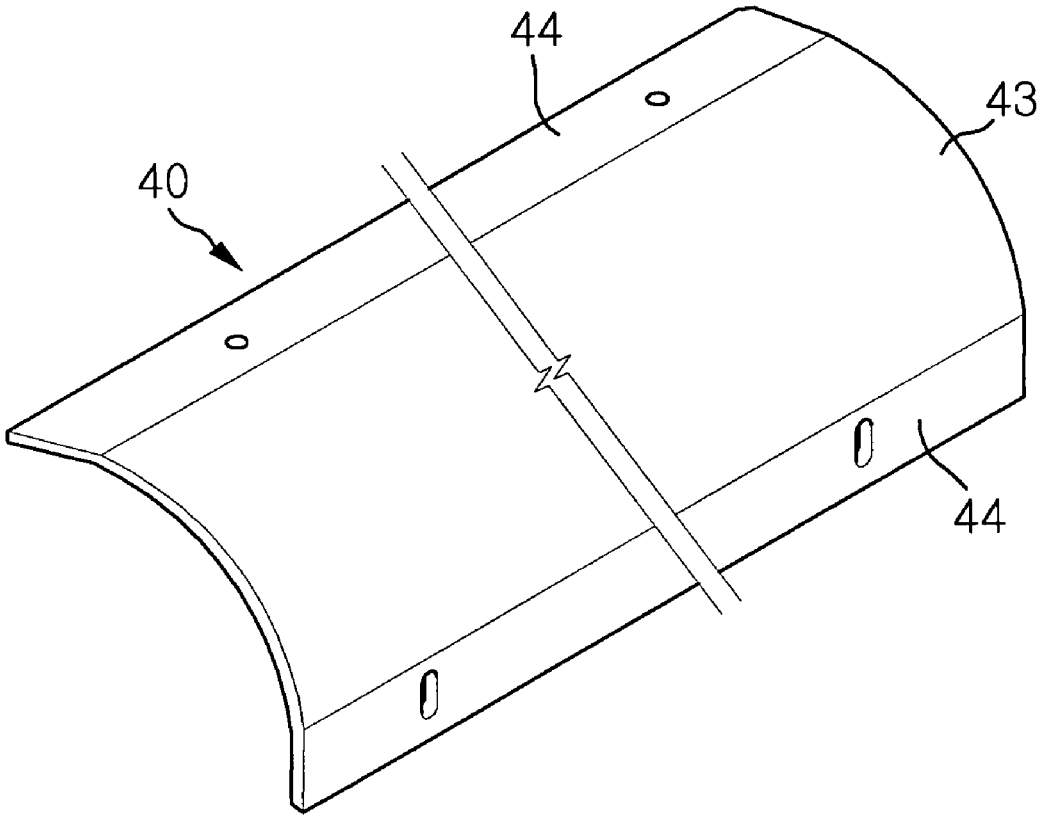
FIG. 5 is a perspective view of another embodiment of the discharge guide portion.

FIG. 5 is a perspective view of another embodiment of the discharge guide portion.

As shown in FIG. 5, an internal temperature difference preventing structure for a refrigerator comprises the discharge guide portion 40 including a curved plate 43 installed at the rear corner of the inside of the main body 1 at a designated angle, and flanges 44 protruded from upper and lower ends of the curved plate 43 so that the curved plate 43 is installed in the main body 1 by means of the flanges 44.

The discharge guide portion 40 serves to guide the cool air, discharged toward the curved plate 43, by means of the curved plate 43, and the flanges 44 protruded from the upper and lower ends of the curved plate 43 facilitate the installation of the curved plate 43 in the main body 1.

Figure 6:
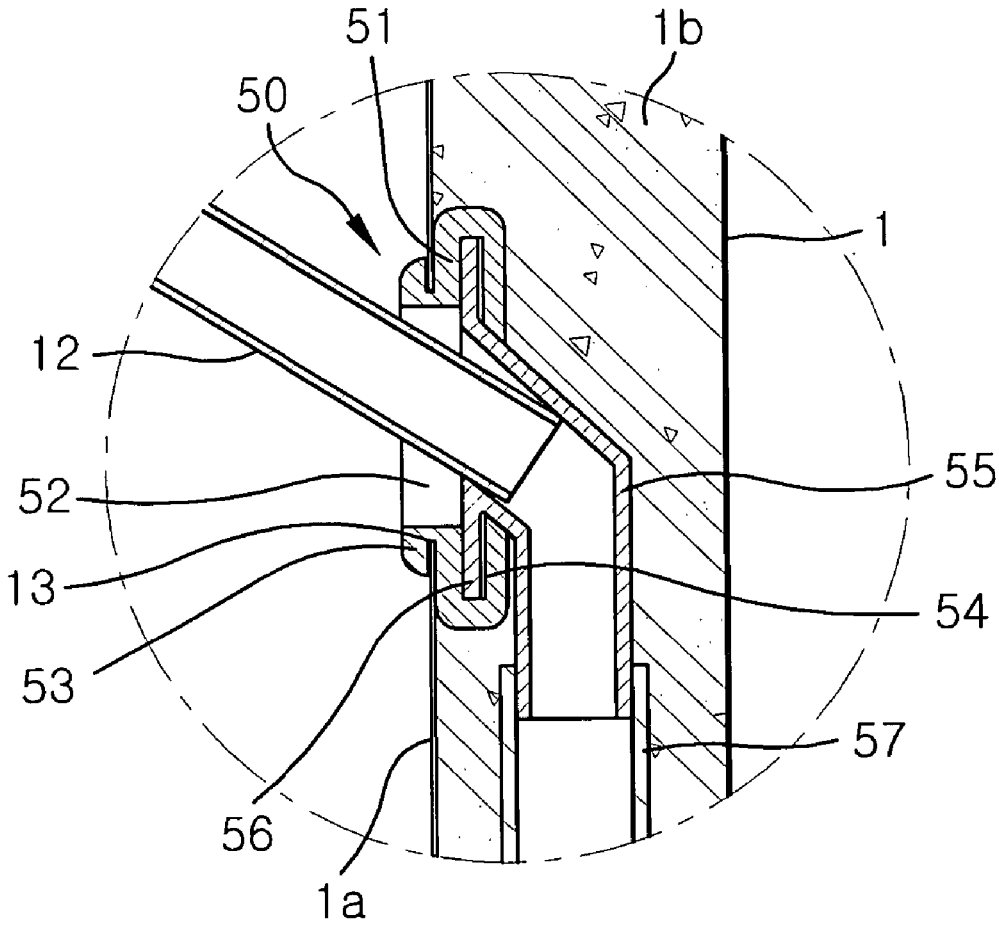
FIG. 6 is an enlarged view of the portion "A" of FIG. 3.
Figure 7:
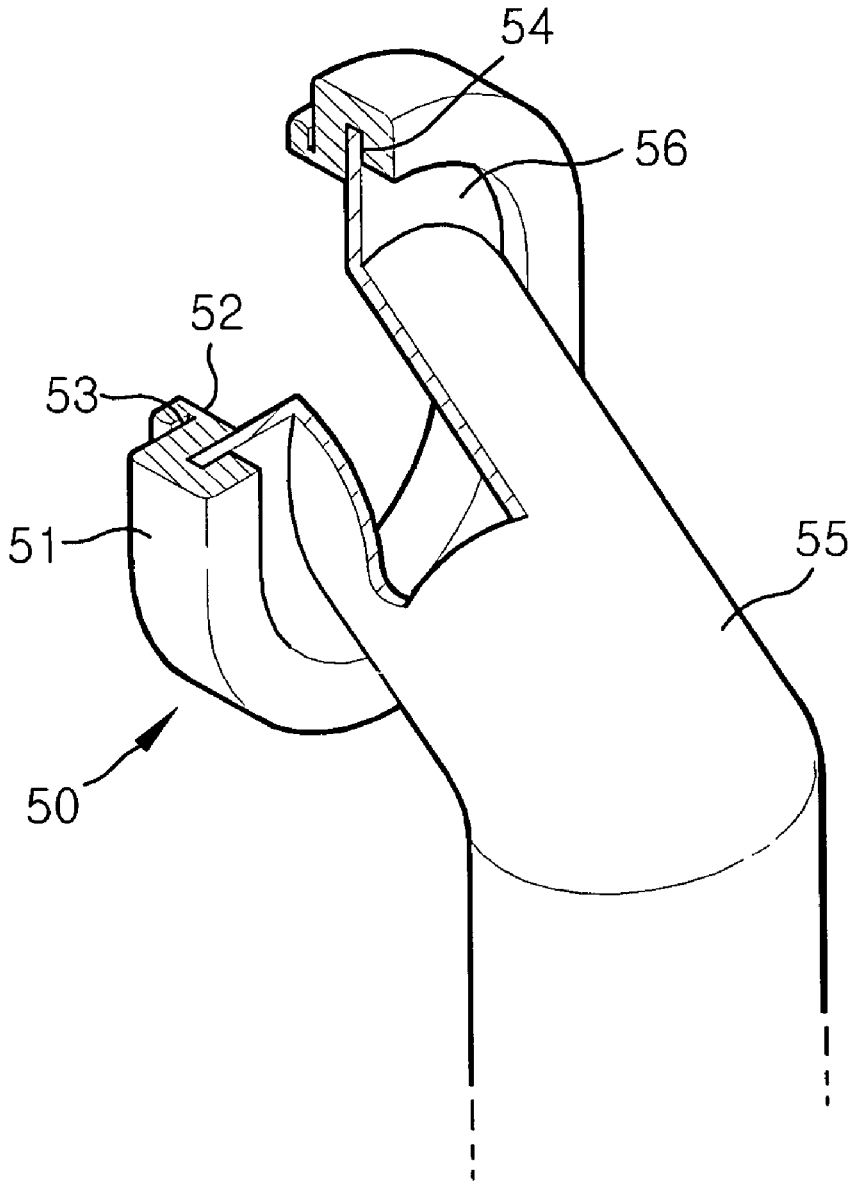
FIG. 7 is a partially exploded perspective view of FIG. 6.

FIG. 6 is an enlarged view of the portion "A" of FIG. 3, and FIG. 7 is a partially exploded perspective view of FIG. 6.

As shown in FIGS. 6 and 7, the discharge pipe 12 connected to the bucket of the evaporator is inserted into a sealing member 50, which is inserted into a discharge hole 13 formed in the rear part of the main body 1, thereby allowing the condensate water of the evaporator to be efficiently discharged to the outside.

The sealing member 50 includes a contact plate 51 adhered to the rear surface of an inner plate 1*a* of the main body 1 corresponding to the discharge hole 13, a cavity 52 formed in the contact plate 51 corresponding to the discharge hole 13, a reception groove 53 formed in the front portion of the contact plate 51 for receiving the inner plate 1*a* provided with the discharge hole 13, and a rear reception groove 54 formed in the periphery of the rear end of the contact plate 51.

A protrusion 56 formed on the upper end of a bent connecting pipe 55, which is placed in an adiabatic material 1*b*, is inserted into the rear reception groove 54 so that the end of the discharge pipe 12 is inserted into the sealing member 50, and the lower end of the bent connecting pipe 55 is inserted into a drainage pipe 57.

The sealing member 50 serves to thermally insulate the discharge hole 13 by sealing the circumference of the discharge hole 13, and to fix the bent connecting pipe 55. The sealing member 50 is made of a soft synthetic resin.

Further, the sealing member 50 serves to prevent a foaming fluid of the adiabatic material 1*b*, formed inside the inner plate 1*a*, from soaking the inside of the main body 1 and the bent connecting pipe 55.

The sealing member 50 thermally insulates a portion of the main body 1 around the discharge hole 13, thereby preventing a temperature difference from being generated around the discharge hole 13.

Figure 8:
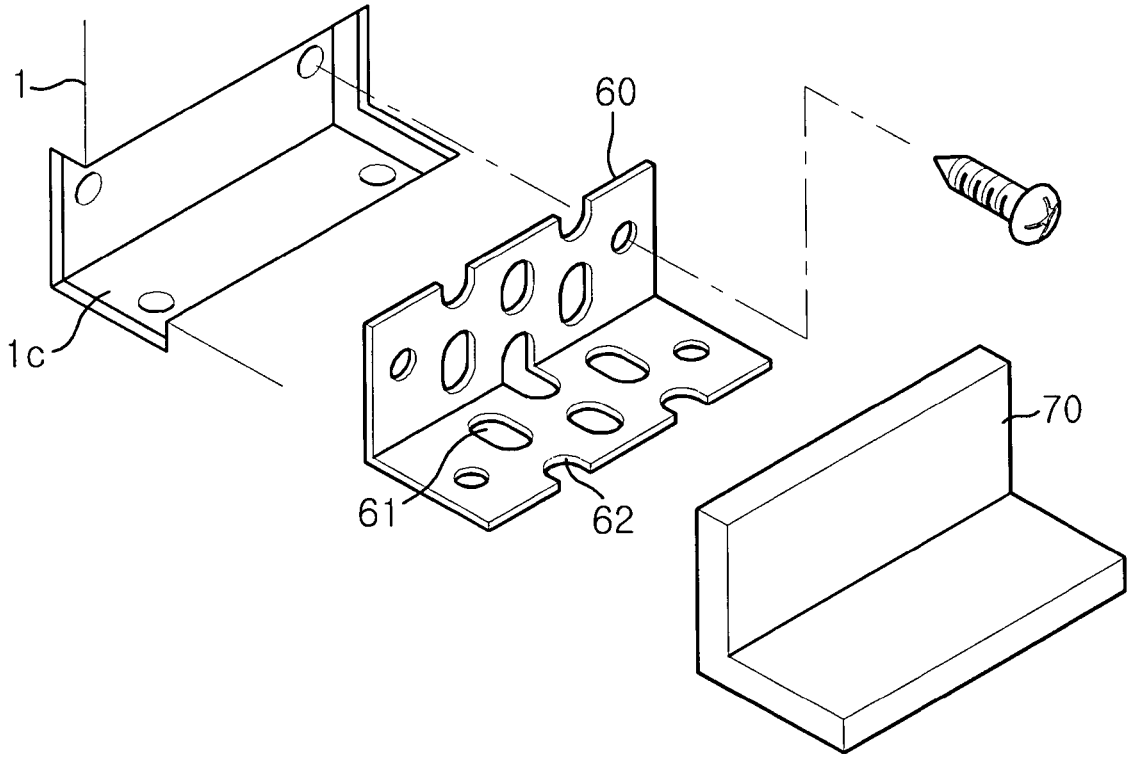
FIG. 8 is an exploded perspective view of the portion "B" of FIG. 3.
Figure 9:
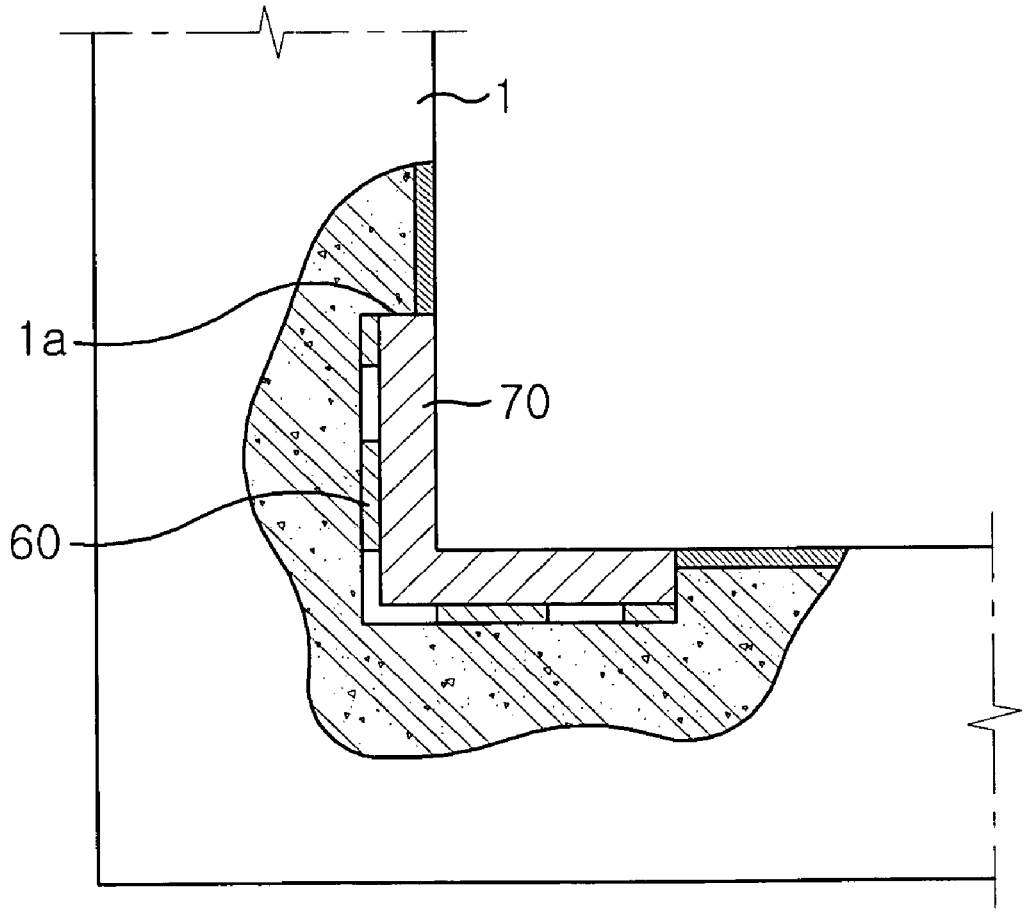
FIG. 9 is an assembled sectional view of FIG. 8.

FIG. 8 is an exploded perspective view of the portion "B" of FIG. 3, and FIG. 9 is an assembled sectional view of FIG. 8.

As shown in FIGS. 8 and 9, a corner groove 1*c* is formed at each of corners of the front portion of the main body 1, an L-shaped support bracket 60 is inserted into the corner groove 1*c*, and a bracket cover 70 is attached to the upper surface of the support bracket 60.

The support bracket 60 is made of a metal material and serves to firmly support the corners of the main body 1, and the bracket cover 70 serves to cover the support bracket 60 so that the support bracket 60 is not exposed to the outside.

A plurality of adiabatic through holes 61 are formed through the support bracket 60 so that the adiabatic through holes 61 formed in one surface of the support bracket 60 do not overlap with the adiabatic through holes 61 formed in the other surface of the support bracket 60, and a plurality of adiabatic indentations 62 are formed in upper and lower ends of the support bracket 60.

The adiabatic through holes 61 and the adiabatic indentations 62 serve to thermally insulate the support bracket 60 by intercepting the cool air conducted from the rear end of the support bracket 60 to the front end of the support bracket 60, thereby preventing a temperature difference generated around the corners of the main body 1, in which the support bracket 60 is installed.

Figure 10:
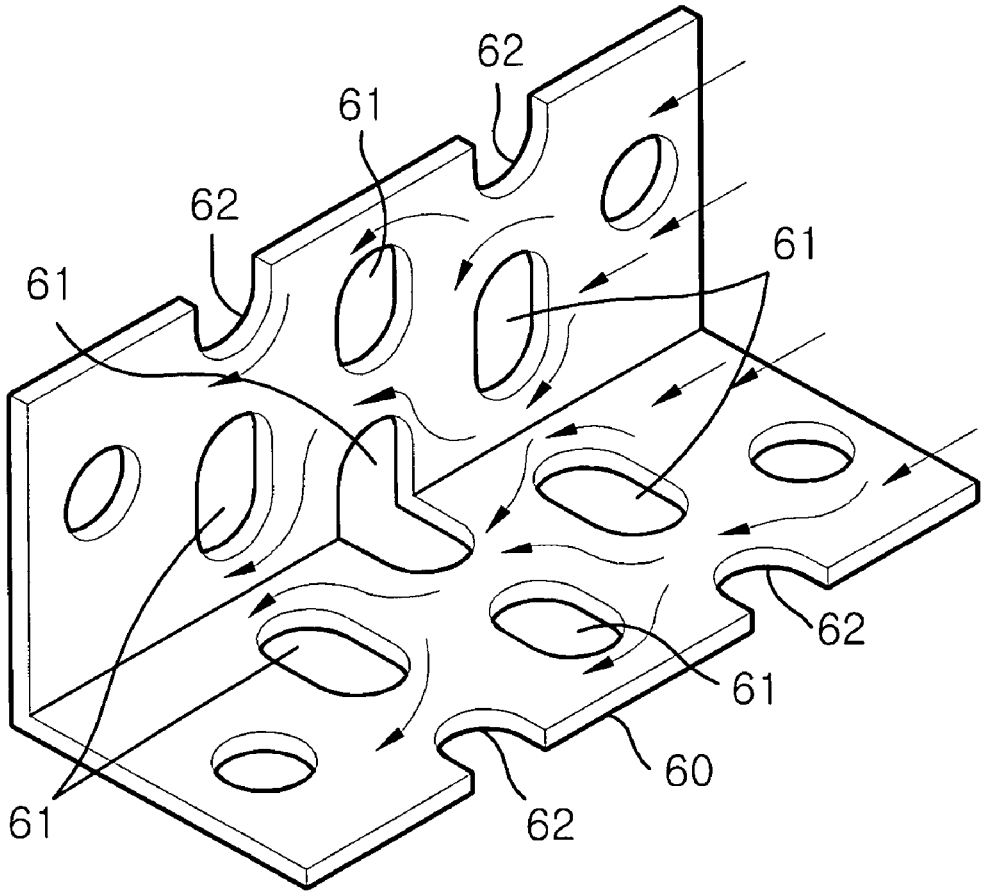
FIG. 10 is an enlarged view of a main portion of FIG. 8.

FIG. 10 is an enlarged view of a main portion of FIG. 8.

As shown in FIG. 10, the cool air sucked into the rear end of the support bracket 60 at the inner corner of the main body 1 flows along the support bracket 60 made of a metal material, and is conducted to the front end of the support bracket 60.

Here, the cool air conducted from the rear end to the front end of the support bracket 60 is intercepted by the adiabatic through holes 61 and the adiabatic indentations 62 formed in the upper and lower ends of the support bracket 60, thus causing a long conduction distance to be lengthened and allowing the support bracket 60 to be thermally insulated.

As apparent from the above description, the present invention provides an internal temperature difference preventing structure for a refrigerator, which prevents a temperature difference between upper and lower portions of the interior of the refrigerator, thereby maintaining a uniform temperature in the interior of the refrigerator.

Further, the internal temperature difference preventing structure of the present invention seals and thermally insulates a discharge hole formed in an inner surface of a main body of the refrigerator for discharging condensed water, thereby preventing variation in the temperature around the discharge hole and a temperature difference around the discharge hole.

Moreover, the internal temperature difference preventing structure of the present invention thermally insulates support brackets for supporting the main body of the refrigerator, thereby preventing variation in the temperature around an inner corners of the main body, at which the support brackets are installed, and a temperature difference around the support brackets.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An internal temperature difference preventing structure for a refrigerator, comprising:

an evaporator installed in an upper portion of a refrigerating space inside a main body of the refrigerator;

a bucket placed under the lower part of the evaporator;

a discharge hole formed through an inner plate and an adiabatic member of the main body;

a discharge pipe connected to the bucket and inserted into the discharge hole; and a sealing member, for sealing and thermally insulating the circumference of the discharge hole, including:

a contact plate adhered to the inner plate of the main body corresponding to the discharge hole;

a cavity formed in the contact plate corresponding to the discharge hole; and a reception groove, formed in the periphery of the front end of the contact plate, for receiving the inner plate provided with the discharge hole.

2. The internal temperature difference preventing structure as set forth in claim 1, wherein the sealing member further includes:

a rear reception groove formed in the periphery of the rear end of the contact plate;

a bent connecting pipe provided with a portion inserted into the rear reception groove and a lower end downwardly bent from the portion; and a drainage pipe, into which the bent connecting pipe is inserted.

3. An internal temperature difference preventing structure for a refrigerator, comprising:

corner grooves formed at corners of a front portion of a main body of the refrigerator;

L-shaped support brackets inserted into the corner grooves for supporting and reinforcing the corners of the main body;

a plurality of through holes formed through the support brackets;

a plurality of through indentations formed in upper and lower ends of each of the support brackets; and bracket covers respectively attached to the upper surfaces of the support brackets.

4. The internal temperature difference preventing structure as set forth in claim 3, wherein the adiabatic through holes and the adiabatic indentations formed through one surface of the L-shaped support bracket do not overlap with the adiabatic through holes and the adiabatic indentations formed through the other surface of the L-shaped support bracket.

* * * * *